United States Patent [19]

Lidén

[11] 4,436,050

[45] Mar. 13, 1984

[54] SEMI-SUBMERSIBLE VESSEL

[75] Inventor: Hadar Lidén, Västra Frölunda, Sweden

[73] Assignee: Gotaverken Arendal AB, Gothenburg, Sweden

[21] Appl. No.: 309,475

[22] Filed: Oct. 7, 1981

[30] Foreign Application Priority Data

Oct. 23, 1980 [SE] Sweden ..... 8007434

[51] Int. Cl.[3] ..... B63B 35/44

[52] U.S. Cl. ..... 114/265; 114/61

[58] Field of Search ..... 114/61, 265, 256, 49–51; 405/202, 203, 206, 207, 208

[56] References Cited

U.S. PATENT DOCUMENTS

| | | | |
|---|---|---|---|
| 2,375,286 | 5/1945 | Creed | 114/265 |
| 3,391,666 | 7/1968 | Schuller, Jr. | 114/265 |
| 3,490,406 | 1/1970 | O'Reilly et al. | 114/265 |
| 3,830,176 | 8/1974 | Arita et al. | 114/265 |
| 3,919,957 | 11/1975 | Ray et al. | 114/265 |
| 3,986,471 | 10/1976 | Haselton | 114/265 |
| 4,112,864 | 9/1978 | Bergman | 114/265 |

*Primary Examiner*—Sherman D. Basinger

*Attorney, Agent, or Firm*—Cantor and Lessler

[57] ABSTRACT

In order to simplify the construction and to reduce the resistance to flow, and to provide a high amount of inertia in relation to all essential axes, an offshore vessel comprises two parallel under-water bodies, four columns mounted symmetrically thereupon, and a multi-deck box-like structure interconnecting the upper ends of the columns. This structure will increase the strength of the vessel so only one horizontal, transverse stay is required between each pair of columns. Below each column there is a 360°-turnable shrouded propeller, which together can hold the vessel stationary, with a vertical line of symmetry in a desired position, for instance above a borehole. The box structure is outwardly completely closed at the bottom and sideplating, and will, in case of need, retain the vessel floating.

2 Claims, 2 Drawing Figures

SEMI-SUBMERSIBLE VESSEL

BACKGROUND OF THE INVENTION

Semi-submersible vessels of different kinds are used in connection with offshore operations. A common type of such a vessel comprises two parallel under-water hulls and an operating deck supported thereby by columns.

The operating deck is designed for carrying equipment and staff accomodations above the deck, and a comprehensive staying is required between the columns as such, and between the columns and the deck. Generally six columns are used, which together with the stays form a considerable resistance to flow, when the vessel is under way or is kept stationary, respectively, over a prospecting area or a drilling hole.

The object of the present invention is to simplify the construction in general, and to reduce the resistance to flow. A further object is to provide a possibility considerably to increase the safety against total loss. It is furthermore of interest to provide an embodiment having a small water-line area and a high and uniform inertia relative to all essential axes, which will facilitate the retention of the vessel in a desired position.

SUMMARY OF THE INVENTION

A vessel according to the invention comprises two parallel under-water hulls, and an operating deck supported thereby by columns, and is characterized in that the operating deck is shaped as a multi-deck, high box structure rigidly interconnecting the upper ends of the columns, which otherwise are interconnected in pairs, each by a horizontal stay only, arranged transversely to the extension of the under-water hulls, and at a height just above said hulls.

Preferably, the deck box is shaped as a self-supporting displacement body, having sufficient volume to hold the vessel floating in case of damage to either or both hulls.

The number of columns is advantageously four, and they are arranged at generally equal distances from each other, and at the same distance from a vertical symmetry line through the vessel, a 360°-turnable propeller, preferably of the shrouded propeller type, being mounted below each column.

DESCRIPTION OF A PREFERRED EMBODIMENT

Figure 1:
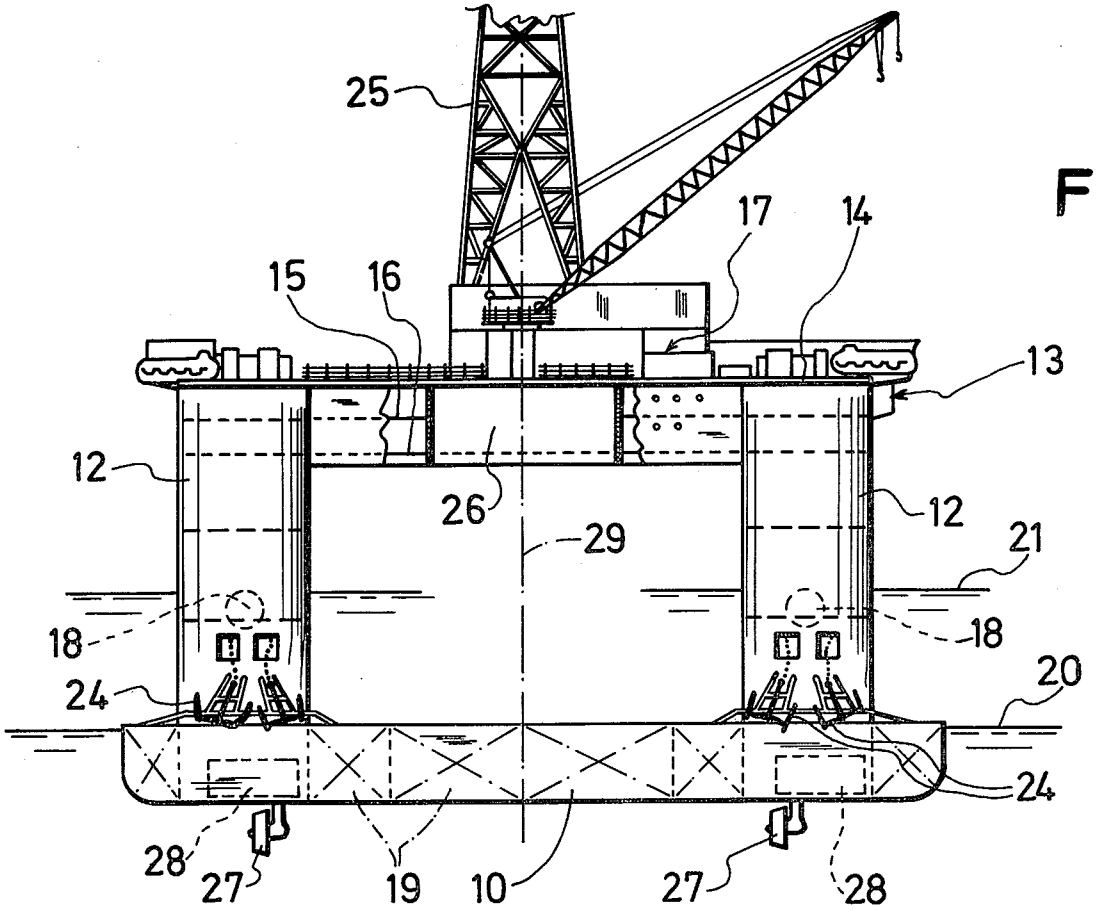
FIG. 1 is an elevation view of a drilling rig according to the invention.

A vessel according to the invention comprises two parallel, under-water hulls 10, 11 and four cylindrical columns 12 located at the ends of the under-water hulls. The upper ends of the columns are interconnected by a rigid box structure 13, which partly forms the operating deck 14, partly comprises several internal decks 15, 16, divided into dwelling facilities, stores, work shops, etc.

The box structure is shaped as an outwardly closed, displacement body. At a serious damage to one under-water hull or column, which implies a risk of the vessel sinking, the deck box will act as a buoyancy body and prevent total loss.

By means of the rigid box structure the need for stays is reduced to a great extent, and there is merely one horizontal, transverse stay 18 between each pair of columns at the ends of the under-water hulls.

In a known manner, the under-water hulls 10, 11 are divided into ballast tanks 19 connected to a pump machinery allowing altering the draft of the vessel. When the vessel is moved, the decks of the hulls are maintained at a water-line denoted 20, and it is observed that the cross stays 18, during propulsion, are kept above this water-line.

The height of the columns 12 is such that the water-line 21 during operation at the field is located approximately at half the height of the columns, guaranteeing that the deck box is located well above the waves, and that the hulls are immersed to such an extent that they are not noticeably affected by wave movements. The columns are also divided into tank rooms and stores around access wells 22. There are also chain boxes 23 connected to hawses for anchors 24.

The vessel shown is intended to be used as an oil drilling rig, and is provided with a drilling derrick 25 placed above a well 26 located centrally in the deck box 13. At prospecting and drilling operations it is necessary to be able to maintain the vessel in a definite position. Below each column 12 there is a 360°-turnable, shrouded propeller 27, which is driven by a suitable power source 28, for instance a diesel engine or electric motor supplied with current from a diesel generator mounted in the deck box.

All propellers co-operate for propulsion and steering when moving the platform, and may be manoeuvred separately for maintaining a desired position. In view of manoevres of the latter type it is essential firstly that there is a small water-line resistance, and secondly that the columns are symmetrically placed in relation to a vertical line of symmetry 29. The distances between the columns 12, and the distance to the symmetry line, respectively, are thus generally equal. The location of the columns, furthermore, gives a large inertia at the operation water-line.

The embodiment described above and shown on the drawings is merely an example of the invention, and the components thereof may be varied in different ways within the scope of the accompanying claims, and in view of the field of use and the size.

What I claim is:

1. A semisubmersible vessel comprising:

(A) two parallel under-water hulls;

(B) an operating deck shaped as a self-supporting displacement body, having sufficient volume to hold the vessel floating;

(C) two pairs of columns connecting said operating deck with said under-water hulls, and arranged at generally equal distances from each other and at the same distance from a vertical line of symmetry through the vessel;

(D) said operating deck being a multi-deck high box structure rigidly interconnecting the upper ends of said columns and extending downwardly below the upper ends of the columns;

(E) said under-water hulls and said columns being so constructed that said operating deck is located substantially above wave level and said under-water hulls are immersed sufficiently below water level to assure that they are not noticeably affected by wave movements; and (F) a horizontal stay means interconnecting each set of juxtaposed columns in each of said pairs thereof and arranged transversely to said under-water hulls, just above the decks thereof and below the water level;

(G) the space between said operating deck and said horizontal stay means being free of obstructing cross-braces.

2. A vessel according to claim 1 further having a 360°-turnable propeller in said under-water hulls below each of said columns.

* * * * *

REEXAMINATION CERTIFICATE (464th)

United States Patent [19]

[11] B1 4,436,050

Lidén

[45] Certificate Issued Feb. 11, 1986

[54] SEMI-SUBMERSIBLE VESSEL

[75] Inventor: Hadar Lidén, Västra Frölunda, Sweden

[73] Assignee: Gotaverken Arendal AB, Gothenburg, Sweden

Reexamination Request:
No. 90/000,702, Jan. 8, 1985

Reexamination Certificate for:

| | |
|---|---|
| Patent No.: | **4,436,050** |
| Issued: | **Mar. 13, 1984** |
| Appl. No.: | **309,475** |
| Filed: | **Oct. 7, 1981** |

[30] Foreign Application Priority Data

Oct. 23, 1980 [SE] Sweden ..... 8007434

[51] Int. Cl.[4] ..... B63B 35/44

[52] U.S. Cl. ..... 114/265; 114/61

[58] Field of Search ..... 114/61, 265, 256, 49–51; 405/202, 203, 206, 207, 208

[56] References Cited

U.S. PATENT DOCUMENTS

| | | | |
|---|---|---|---|
| 2,375,286 | 5/1945 | Creed | 114/265 |
| 3,391,666 | 7/1968 | Schuller, Jr. | 114/265 |
| 3,490,406 | 1/1970 | O'Reilly et al. | 114/265 |
| 3,830,176 | 8/1974 | Arita et al. | 114/265 |
| 3,919,957 | 11/1975 | Ray et al. | 114/265 |
| 3,986,471 | 10/1976 | Haselton | 114/265 |
| 4,112,864 | 9/1978 | Bergman | 114/265 |

OTHER PUBLICATIONS

Alan C. McClure, "Development of the Project Mohole Drilling Platform", Nov. 11–12, 1965, The Society of Naval Architects and Engineers, pp. 80–81.

Figure 2:
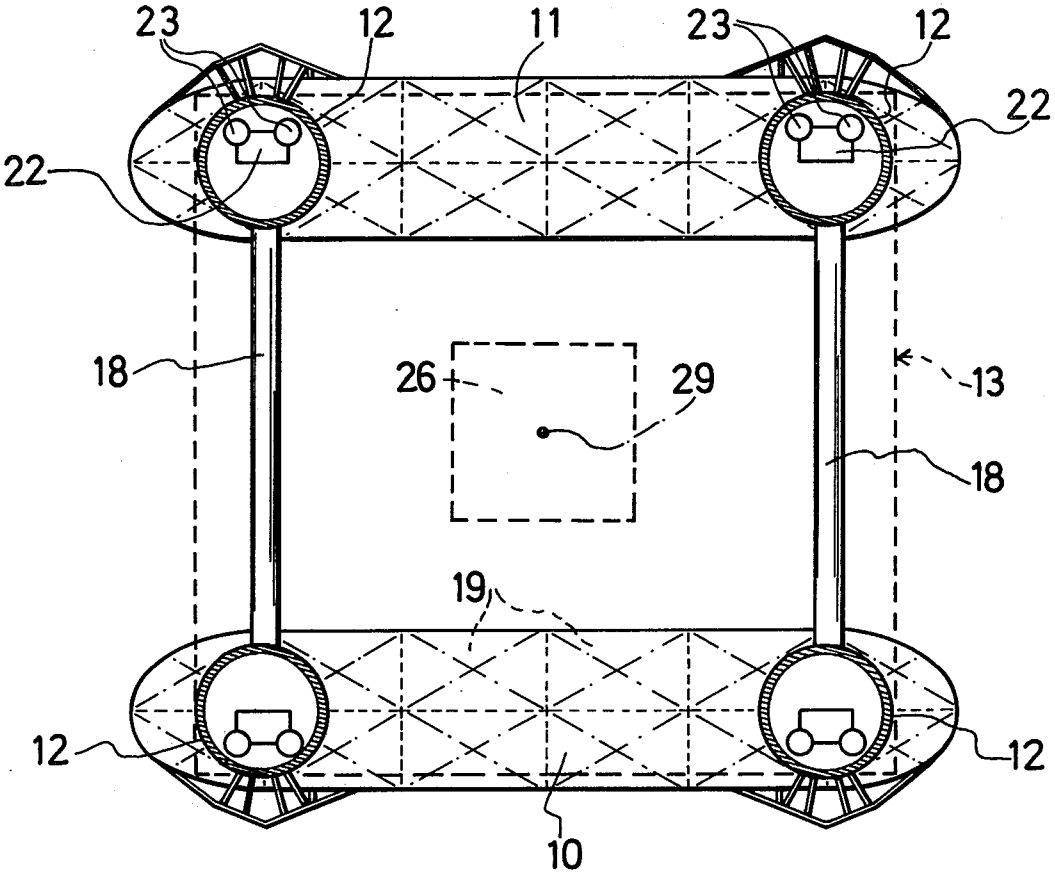
FIG. 2 is a horizontal section, approximately at the water-line during operation.

P. S. Heerema & F. C. Michelsen, "The Semi-Submersible Crane Vessel 'Balder'" Oct. 24–27, 1978; European Offshore Petroleum Conference & Exhib., FIGS. 1 & 2.

F. C. Michelsen, "On the Design and Construction Of the Heerema Semi-Submersible Crane Vessel", Mar. 6–10, 1978, Oceanology International 78, p. 31+, Part G.

Heerema Marine Contractors ad; "Ocean Industry", Jan. 1978, p. 9.

Heerema Marine Contractor ad; "Offshore Services", May 1979, p. 9.

NOROIL–May 1980, pp. 83 and 85.

*Primary Examiner*—Sherman D. Basinger

[57] ABSTRACT

In order to simplify the construction and to reduce the resistance to flow, and to provide a high amount of inertia in relation to all essential axes, an offshore vessel comprises two parallel under-water bodies, four columns mounted symmetrically thereupon, and a multi-deck box-like structure interconnecting the upper ends of the columns. This structure will increase the strength of the vessel so only one horizontal, transverse stay is required between each pair of columns. Below each column there is a 360°-turnable shrouded propeller, which together can hold the vessel stationary, with a vertical line of symmetry in a desired position, for instance above a borehole. The box structure is outwardly completely closed at the bottom and sideplating, and will, in case of need, retain the vessel floating.

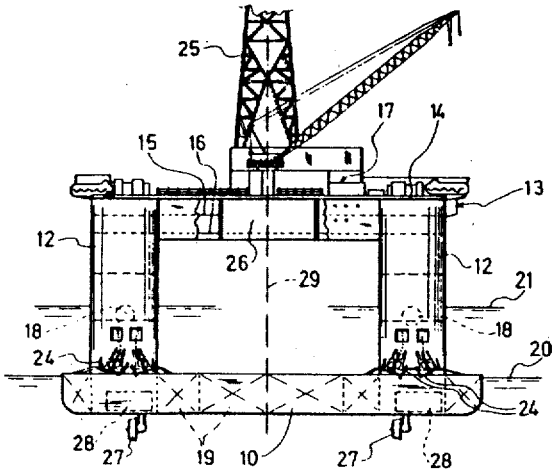

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 64–68:

*Access is possible from the main deck, preferably by way of some building 17 thereon.* The box structure is shaped as an outwardly closed, displacement body. At a serious damage to one underwater hull or column, which implies a risk of the vessel sinking, the deck box will act as a buoyancy body and prevent total loss.

AS A RESULT OF REEXAMINATION, IT HAS BEEN DETERMINED THAT:

The patentability of claims 1 and 2 is confirmed.

New claims 3–12 are added and determined to be patentable.

*3. A semisubmersible vessel having a small water-line area and a high and uniform inertia relative to all essential axes comprising:*

*(A) two parallel under-water hulls;*

*(B) an operating deck shaped as a self-supporting displacement body, having sufficient volume to hold the vessel floating;*

*(C) two pairs of columns connecting said operating deck with said under-water hulls, and arranged at generally equal distances from each other and at the same distance from a vertical line of symmetry through the vessel;*

*(D) said operating deck being a multi-deck high rigid box structure rigidly interconnecting the upper ends of said columns and extending downwardly below the upper ends of the columns;*

*(E) said under-water hulls and said columns being so constructed that said operating deck is located substantially above wave level and said under-water hulls are immersed sufficiently below water level to assure that they are not noticeably affected by wave movements; and*

*(F) a horizontal stay means interconnecting each set of juxtaposed columns in each of said pairs thereof and arranged transversely to said under-water hulls, just above the decks thereof and below the water level;*

*(G) the space between said operating deck and said horizontal stay means being free of obstructing cross-braces.*

*4. A vessel according to claim 3 further having a 360°-turnable propeller in said under-water hulls below each of said columns.*

*5. A vessel according to claim 3 which is configured as a drilling rig.*

*6. A vessel according to claim 1 which is configured as a drilling rig.*

*7. A vessel according to claim 3 which is configured as a production rig.*

*8. A vessel according to claim 1 which is configured as a production rig.*

*9. A semisubmersible vessel having a small water-line area and a high and uniform inertia relative to all essential axes comprising:*

*(A) two parallel under-water hulls;*

*(B) an operating deck shaped as an outwardly closed self-supporting displacement body, having sufficient volume to hold the vessel floating;*

*(C) two pairs of columns connecting said operating deck with said under-water hulls, and arranged at generally equal distances from each other and at the same distance from a vertical line of symmetry through the vessel;*

*(D) said operating deck being a multi-deck high rigid box structure rigidly interconnecting the upper ends of said columns and extending downwardly below the upper ends of the columns;*

*(E) said under-water hulls and said columns being so constructed that said operating deck is located substantially above wave level and said under-water hulls are immersed sufficiently below water level to assure that they are not noticeably affected by wave movements; and*

*(F) a horizontal stay means interconnecting each set of juxtaposed columns in each of said pairs thereof and arranged transversely to said under-water hulls, just above the decks thereof and below the water level;*

*(G) the space between said operating deck and said horizontal stay means being free of obstructing cross-braces.*

*10. A vessel according to claim 9 further having a 360°-turnable propeller in said under-water hulls below each of said columns.*

*11. A vessel according to claim 9 which is configured as a drilling rig.*

*12. A vessel according to claim 9 which is configured as a production rig.*

* * * * *